US007725976B1

(12) United States Patent
Crank et al.

(10) Patent No.: US 7,725,976 B1
(45) Date of Patent: Jun. 1, 2010

(54) APPARATUS AND METHOD FOR THE AUTOMATED CLEANING OF ARTICLES

(75) Inventors: Douglas Crank, Holland, MI (US); Arthur H. Johnson, Jr., Grand Haven, MI (US); William F. Meyers, Hamilton, MI (US); Clinton L. Allen, Medina, OH (US)

(73) Assignee: The Sherwin-Williams Company, Cleveland, OH (US)

( * ) Notice: Subject to any disclaimer, the term of this patent is extended or adjusted under 35 U.S.C. 154(b) by 1224 days.

(21) Appl. No.: 11/212,340

(22) Filed: Aug. 26, 2005

Related U.S. Application Data

(60) Provisional application No. 60/604,570, filed on Aug. 26, 2004.

(51) Int. Cl.
*A47L 15/00* (2006.01)
*A47L 25/00* (2006.01)

(52) U.S. Cl. ..... 15/88.3; 15/302; 15/306.1

(58) Field of Classification Search ..... 15/88.3, 15/302, 306.1
See application file for complete search history.

(56) References Cited

U.S. PATENT DOCUMENTS

| | | | |
|---|---|---|---|
| 668,490 | A | 2/1901 | Cosens |
| 1,280,731 | A | 10/1918 | Herr |
| 2,248,597 | A | 7/1941 | Wynne |
| 2,508,021 | A | 5/1950 | Gerlach |
| 2,935,479 | A | 5/1960 | Oberdorfer |
| 3,039,610 | A | 6/1962 | Black |
| 3,070,463 | A | 12/1962 | Barday |
| 3,231,424 | A | 1/1966 | Evans et al. |
| 3,262,460 | A | 7/1966 | Huddle et al. |
| 3,284,828 | A | 11/1966 | Jennings et al. |
| 3,382,181 | A | 5/1968 | Oberdorfer |

(Continued)

FOREIGN PATENT DOCUMENTS

| | | |
|---|---|---|
| EP | 0268344 B1 | 5/1988 |

(Continued)

OTHER PUBLICATIONS

SOLTROL 220 Isoparaffin Solvent, MSDS, Mar. 20, 2003, USA.

(Continued)

*Primary Examiner*—Randall Chin
(74) *Attorney, Agent, or Firm*—Eryne Ace Fuhrer; Robert E. McDonald; Arthi K. Tirey

(57) ABSTRACT

An apparatus, formulation and method for cleaning soils, such as paint drips or splashes, from the outside surface of filled aerosol paint cans and other articles is provided. The apparatus comprises a plurality of reservoirs containing liquids for cleaning and rinsing articles. Articles to be cleaned travel on a conveyor system comprised of one or more mechanical conveyors. During the cleaning operation, one or more brushes apply cleaning solution to the articles, an air knife blows excess cleaning solution and/or solid soils off of the articles, and a jet spray rinses the articles. Another air knife may be used to dry the cleaned articles. The apparatus also includes a plurality of recirculation devices for removing solids from the cleaning and rinsing liquids so that these liquids may be reused in the cleaning operations. A cleaning formulation comprised of a glycol ether and hydrocarbon solvent is also provided.

10 Claims, 7 Drawing Sheets

U.S. PATENT DOCUMENTS

| | | | | |
|---|---|---|---|---|
| 3,508,997 | A | 4/1970 | Werling | |
| 3,709,825 | A | 1/1973 | Chirash et al. | |
| 3,751,970 | A | 8/1973 | Alburger | |
| 3,837,037 | A | 9/1974 | Wright | |
| 3,849,831 | A | 11/1974 | DeVerter et al. | |
| 3,929,664 | A | 12/1975 | Alburger | |
| 3,989,001 | A | 11/1976 | Brigham et al. | |
| 4,365,383 | A | 12/1982 | Bartlett | |
| 4,439,882 | A | 4/1984 | Holm | |
| 4,740,247 | A | 4/1988 | Hayes et al. | |
| 4,822,514 | A | 4/1989 | Becker | |
| 4,830,882 | A | 5/1989 | Ichinose et al. | |
| 4,836,950 | A | 6/1989 | Madsen et al. | |
| 4,859,359 | A | 8/1989 | DeMatteo et al. | |
| 4,923,760 | A | 5/1990 | Adkins et al. | |
| 5,009,758 | A | 4/1991 | Okada et al. | |
| 5,011,621 | A | 4/1991 | Sullivan | |
| 5,097,630 | A | 3/1992 | Maeda et al. | |
| 5,113,882 | A | 5/1992 | Gileta | |
| 5,143,639 | A | 9/1992 | Krawack | |
| 5,167,853 | A | 12/1992 | Stevens | |
| 5,188,754 | A | 2/1993 | Weltman et al. | |
| 5,237,716 | A * | 8/1993 | Lisec | 15/77 |
| 5,306,350 | A | 4/1994 | Hoy et al. | |
| 5,332,526 | A | 7/1994 | Stanley | |
| 5,334,256 | A | 8/1994 | Howe | |
| 5,370,817 | A | 12/1994 | Weltman et al. | |
| 5,372,742 | A | 12/1994 | Bayless | |
| 5,416,253 | A | 5/1995 | Weltman et al. | |
| 5,425,385 | A | 6/1995 | Kuta et al. | |
| 5,437,808 | A | 8/1995 | Weltman et al. | |
| 5,441,063 | A | 8/1995 | Fernandez et al. | |
| 5,449,474 | A | 9/1995 | Lucas et al. | |
| 5,604,196 | A | 2/1997 | Weltman et al. | |
| 5,609,678 | A | 3/1997 | Bergman | |
| 5,612,303 | A | 3/1997 | Takayanagi et al. | |
| 5,729,856 | A | 3/1998 | Jang et al. | |
| 5,816,275 | A | 10/1998 | Mullen | |
| 6,017,862 | A | 1/2000 | Doyel et al. | |
| 6,130,195 | A | 10/2000 | Doyel et al. | |
| 6,230,721 | B1 | 5/2001 | Miyasako | |
| 6,260,231 | B1 | 7/2001 | Bybee et al. | |
| 6,267,124 | B1 | 7/2001 | Bowden | |
| 6,294,508 | B1 | 9/2001 | Milbrath et al. | |
| 6,478,880 | B1 | 11/2002 | Shank | |
| 6,689,734 | B2 | 2/2004 | Doyel et al. | |
| 6,699,829 | B2 | 3/2004 | Doyel et al. | |
| 6,755,871 | B2 | 6/2004 | Damaso et al. | |
| 7,232,493 | B2 * | 6/2007 | Misura et al. | 134/6 |
| 2002/0010965 | A1 | 1/2002 | Schulte et al. | |
| 2002/0111283 | A1 | 8/2002 | Argentieri et al. | |

FOREIGN PATENT DOCUMENTS

| | | | |
|---|---|---|---|
| EP | 0598023 | B1 | 5/1994 |
| EP | 0616016 | B1 | 9/1994 |
| EP | 0713381 | B1 | 5/1996 |
| EP | 0822241 | B1 | 2/1998 |
| EP | 0959983 | B1 | 12/1999 |
| JP | 1093197 | | 4/1989 |
| JP | 10323632 | | 12/1998 |
| JP | 11267082 | | 10/1999 |
| JP | 2002239485 | | 8/2002 |
| JP | 2002273367 | | 9/2002 |
| WO | WO9403579 | | 2/1994 |
| WO | WO9413746 | | 6/1994 |
| WO | WO9413777 | | 6/1994 |
| WO | WO9916026 | | 4/1999 |
| WO | WO03018218 | | 3/2003 |

OTHER PUBLICATIONS

DOWANOL PnP Product Information, available at least as early as Jul. 12, 2004.

ARCOSOLV PNP Technical Data, available at least as early Aug. 2004.

CHEMINFO, Chemical profile for 1-Propoxy-2-Propanol, Apr. 21, 1993.

The Registry of Toxic Effects of Chemical Substances, Propanol, 1 (or 2) -propoxy, available at least as early as Jul. 12, 2004.

ARCOSOLV PNP, MSDS, Jan. 24, 2002.

* cited by examiner

APPARATUS AND METHOD FOR THE AUTOMATED CLEANING OF ARTICLES

This application claims priority from U.S. Provisional Application No. 60/604,570, filed Aug. 26, 2004, the entirety of which is hereby incorporated by reference.

This invention is directed to an improved cleaning composition and apparatus for cleaning articles of various shapes and sizes. For example, the apparatus and cleaning composition described herein are useful for cleaning paint drips from the outside of a paint container, after the container has been filled.

During the filling of aerosol paint cans, it is not uncommon for paint to drip or splash onto the outside surface of the can. Typically, after the cans are sealed, a worker will manually clean the drips or splashes from the cans using solvents, brushes, rags or other implements. This manual cleaning process slows down the production process.

In addition, solvents commonly used to dilute or remove paints resins suffer from the major disadvantage of being health and safety hazards. Solvents used for paint thinning or cleaning include aggressive petroleum distillate solvents such as toluene, acetone, LACOLENE®, mineral spirits and turpentine. Such solvents are widely used to let down or partially dissolve and thin—paint bases until the finished paint product reaches a level suitable for customer application. Because these solvents are known to dissolve and/or thin the paint base, they are also very useful as cleaning compositions.

The problems with these solvents are that they have a relatively low flash point and are highly flammable. By way of explanation, every liquid is characterized by a temperature below which it cannot ignite. This temperature is the flash point. The flash point is the lowest temperature at which the liquid vapors can form an ignitable mixture in the air above the liquid. A liquid cannot burn at temperatures low enough to keep the level of flammable fumes in the atmosphere above the liquid below the lower ignition limit. The flash point is measured at 1 bar pressure above which a mixture of oxygen and the equilibrated fumes of a liquid can ignite by means of a small energy source, such as a small static electricity spark. Toluene, for example, has a flash point of 7° C. (45° F.). Acetone is even more dangerous with a flash point of around −20° C. (−4° F.).

Petroleum distillate solvents such as acetone and toluene tend to generate static electricity when they are allowed to free-fall through air. The static electricity is even greater when these chemicals are sprayed at high pressure. Spraying these solvents in an atmosphere with enough oxygen to support ignition creates a very high likelihood of fire. Moreover, spraying these solvents can generate an aerosol suspension of fine droplets in the air, which under the right conditions, can result in a deflagration, or an intense, near-explosive level fire. If the spraying is done in a contained enclosure that can allow pressure to build up before venting the vapors, a deflagration is likely to become a bomb-like detonation that can cause severe injuries and damage to personnel and equipment.

In addition to the danger of fire or explosion, some of these solvents can be toxic to the individuals using the chemicals. Because the cleaning of filled containers is often done by hand in an open work area, these toxic chemicals can be very dangerous to workers. Even in an automated process, it is preferred to keep toxic fumes out of the work area.

Unfortunately, very few alternatives to these solvents are available today. Less hazardous alternatives that are available tend to be more expensive than their counterparts and are widely ignored because they are cost prohibitive. Lower cost alternatives with sufficiently low flash points tend to not be effective for cleaning or thinning paint.

In light of the foregoing limitations in the prior art, there is a need for an automated apparatus and method for cleaning paint drips or splashes from the outside of filled aerosol paint cans. There is a further need for a cleaning solution that has a low flash point and is recyclable to reduce hazardous wastes.

The present invention comprises an inventive cleaning solution useful for removing excess paint from the outside of a paint container. In one embodiment, the cleaning solution comprises a mixture of a coalescing solvent and a hydrocarbon solvent. For example, the cleaning composition may comprise a mixture of one or more glycol ethers, such as propylene glycol propyl ether, and an isoalkane solution, such as a mixture of C13-C16 isoalkanes.

The cleaning apparatus of the present invention comprise two reservoirs, one for holding a cleaning liquid and a second for holding a rinse liquid. A conveyor system passes through the reservoirs and cans travel on the conveyor belt or belts. The cleaning liquid is pumped from its reservoir to a distribution manifold, which applies the cleaning liquid onto a pair of counter rotating brushes. The counter rotating brushes apply the cleaning liquid to the cans as they travel on the conveyor. An air knife may be used to blow air onto the cans at a sufficient pressure to force any solid paint particles or excess liquid off of the cans. The cans may also travel under a water spray head. Water is sprayed onto the cans to rinse off any remaining solid particles and cleaning solution. Filters are included to remove solid particles from the cleaning liquid and/or water before the liquids are applied to the cans.

As will be described in more detail herein, in one embodiment, the cleaning apparatus of the present invention comprises a cleaning liquid reservoir and a rinse liquid reservoir; a conveyor system running through said cleaning liquid reservoir and said rinse liquid reservoir; a pair of brushes for scrubbing articles, such as aerosol paint cans, said pair of brushes mounted above conveyor system within said cleaning liquid reservoir; means for applying cleaning liquid onto said brushes; and means for spraying liquid from said rinse liquid reservoir onto articles on said conveyor system. In one useful embodiment, the rinse liquid may be sprayed at high pressure. In an alternative embodiment, the cleaning apparatus comprises a first reservoir for holding a first liquid; a first conveyor running through said first reservoir; a second reservoir for holding a second liquid; a second conveyor running through said second reservoir; a pair of rotatable brushes positioned above said first conveyor; a first distribution manifold adapted to apply liquid from said first reservoir onto said pair of rotatable brushes; a first pump for delivering liquid from said first reservoir to said distribution manifold; a first filter system positioned between said first reservoir and said first pump; an air knife positioned above said first conveyor; a second distribution manifold positioned above said second conveyor; a second pump for delivering liquid from said second reservoir to said distribution manifold; a second filter system positioned between said second reservoir and said second pump; and a plate positioned between said first and second conveyors, said plate adapted to receive an article as said article passes from said first conveyor. In another alternative embodiment, an apparatus for washing articles comprises: an elongated cleaning solution reservoir comprising a lower section, a pair of lateral side walls extending upwardly from said lower section, and first and second end walls enclosing opposite ends of said lower section and said lateral side walls; first and second tunnels formed in each of said first and second walls in said cleaning solution reservoir, wherein said tunnels are adapted to allow an article to pass through said tunnel; a first conveyor running through said cleaning solution reservoir, said conveyor adapted to transport articles through said cleaning solution reservoir; an elongated water reservoir comprising a lower section, a pair of lateral side walls extending upwardly from said lower section, and first and second end walls enclosing opposite ends of said lower section and said lateral side walls; first and second tunnels formed in each of said first and second end walls, wherein said tunnels are adapted to allow an article to pass through said tunnels; a second conveyor running through said water reservoir, said conveyor adapted to transport articles through said water reservoir; a rectangular plate positioned between said first conveyor and said second conveyor, wherein said plate is level with said first and second conveyors, and wherein a gap of about 0.125 inches separates the plate from each of said first and second conveyors; guide rails for guiding the movement of cans between said first and second conveyor; a first brush, having a plurality of bristles, positioned above said first conveyor proximate to said first end wall of said cleaning solution reservoir, wherein said first brush is mounted on a first rotatable horizontal shaft; a reduction gear transmission connected to said first rotatable horizontal shaft; a motor coupled to said reduction gear transmission; a second brush, having a plurality of bristles, positioned above said conveyor, proximate to said first end wall of said cleaning solution reservoir, wherein said second brush is mounted on a second rotatable horizontal shaft and wherein the bristles of said second brush overlap with the bristles of said first brush so that rotation of said first brush imparts rotational movement to said second brush; a cleaning solution distribution manifold positioned above said first and second brushes for dispensing a cleaning solution from said cleaning solution reservoir onto said brushes; a first pump for pumping cleaning solution from said cleaning solution reservoir to said cleaning solution distribution manifold; a first recirculation device positioned between said cleaning solution reservoir and said first pump, comprising an intake and at least one filter for removing solid particles from said cleaning solution as it passes through said recirculation device to said first pump; an air knife positioned above said first conveyor proximate to said second end wall of said cleaning solution reservoir; a water distribution manifold positioned above said second conveyor for dispensing water onto cans traveling on said conveyor in a predetermined pattern; a second pump for pumping water from said water reservoir to said water distribution manifold; a second recirculation device positioned between said water reservoir and said second pump, comprising an intake and at least one filter for removing solid particles from water as it passes through said recirculation device to said second pump; a first hood positioned over said cleaning solution reservoir, said brushes, said cleaning distribution manifold, and said air knife; and a second hood positioned over said water reservoir and said water distribution manifold.

The invention also comprises method of removing residue or other contaminants from the outside surface of an article traveling on a conveyor system, the method comprising: moving said articles along a conveyor system; applying cleaning solution to a pair of counter rotating brushes; scrubbing the outside surfaces of said articles with said brushes; blowing forced air onto said articles; spraying high pressure water onto said articles; and drying said articles using forced air.

Several drawing figures illustrate exemplary embodiments of the present invention:

Figure 1:
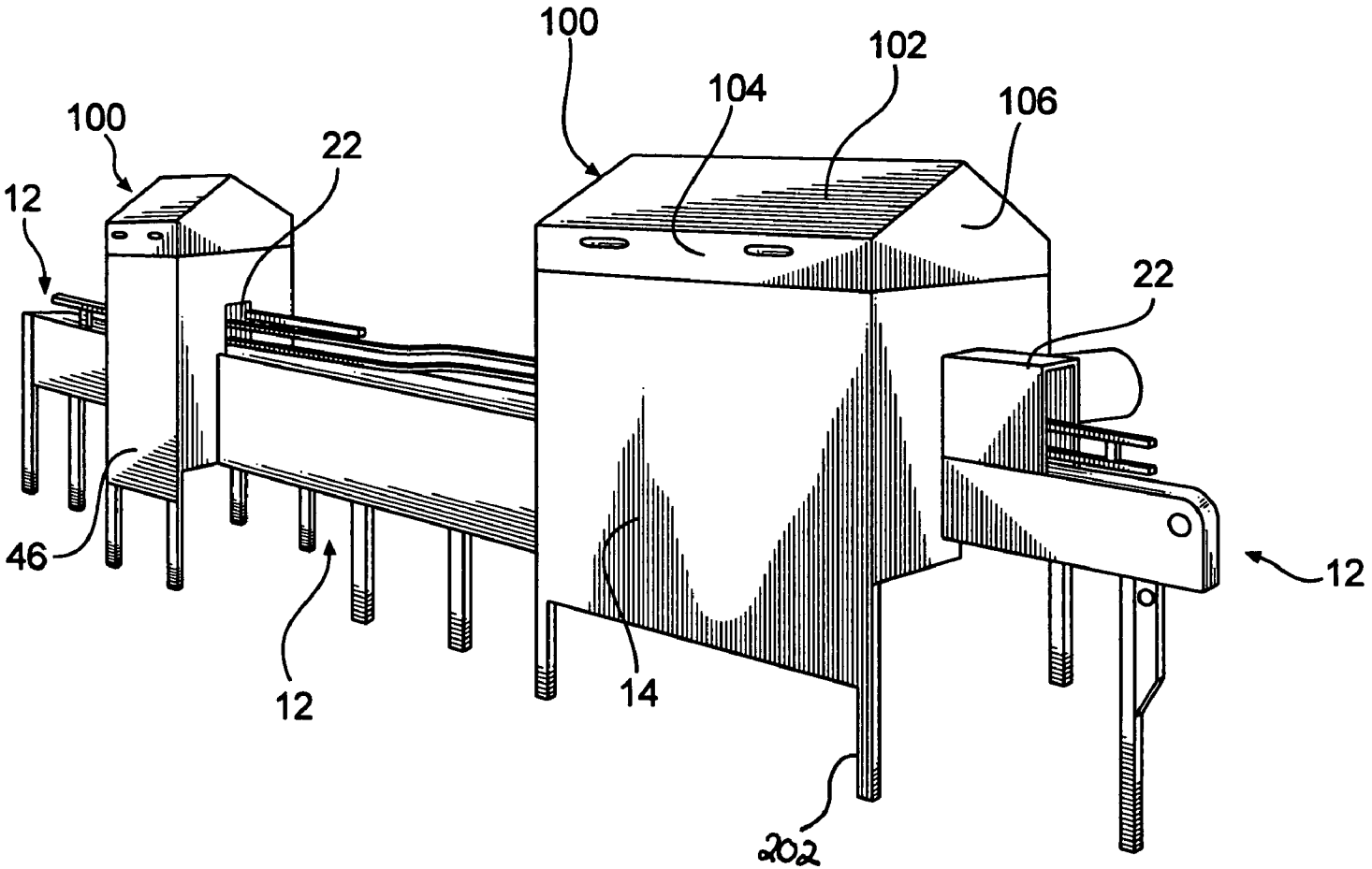
FIG. 1 is an overview of a cleaning apparatus in accordance with the present invention.

With respect to the cleaning apparatus illustrated herein, one of ordinary skill in the art will appreciate that one element may be designed as multiple elements or that multiple elements may be designed as one element. An element shown as an internal component of another element may be implemented as an external component and vice versa.

Further, in the accompanying drawings and description that follow, like parts are indicated throughout the drawings and description with the same reference numerals, respectively. The figures are not drawn to scale and the proportions of certain parts have been exaggerated for convenience of illustration. It should also be noted that in order to clearly and concisely disclose the present invention, certain features of the invention may be shown in somewhat schematic form. Although aerosol paint cans are used as a specific example of an article to be cleaned in accordance with the present invention, it should be understood that articles of various shapes and sizes that travel on a conveyor may be cleaned by the apparatus and method of the present invention. In addition, the cleaning composition of the present invention may be used in a variety of processes in addition to the cleaning method and apparatus described herein.

Turning now to FIGS. 1-6, there is illustrated an apparatus for the automated cleaning of articles, such as filled aerosol paint containers, in accordance with the present invention. The apparatus comprises two elongated reservoirs 14 and 46 for holding various liquids for use in the cleaning operations, such as various cleaning solutions, solvents, or water. In one useful embodiment, the first reservoir 14 contains a cleaning solution, such as a mixture comprising propylene glycol mono-n-propyl ether and a mixture of C13-C16 isoalkanes. For ease of reference, the first reservoir 14 will be referred to herein as a "cleaning solution reservoir" and the second reservoir 46 will be referred to as a "water reservoir." However, it should be understood that any solutions or solvents capable of cleaning and/or rinsing articles may be used in the apparatus of the present invention, and that the solutions contained in the two reservoirs need not be of different compositions.

In one embodiment of the present invention, the reservoirs 14, 46 have lower portions 16, 48 which define a lower region of the reservoir 44, 70. As an example, in one embodiment, the lower portions 16, 48 of the reservoirs may be substantially V-shaped. The lower regions 44, 70 of the reservoirs 14, 46 will contain the bulk of the liquids used in the cleaning process. Lateral side walls 18, 50 extend upwardly from the lower portions 16, 48. The lateral side walls 18, 50 define an upper region 42, 68 in each reservoir 14, 46. Each end of the elongated reservoir is enclosed by end walls 20, 52. The reservoirs 14, 46 are substantially open at the top end. In one useful embodiment, the lower section 16, 48 is sized so that it is capable of holding approximately sixteen (16) gallons of liquid. In another useful embodiment, at least the cleaning solution reservoir 14 is about 29 inches wide between two lateral sidewalls, about 50 inches long between two end walls, and about 37 inches high from the bottom the lower portion to the top of the lateral side walls.

The reservoirs may be constructed of any practical material, for instance metal. In one embodiment, the reservoirs are constructed of sheets of cold rolled steel. At least the outer surface of each reservoir may be coated with any known industrial coating known to retard degradation. The reservoirs may be supported on metal legs 202. In one embodiment, the legs are constructed from square steel tubing. In one embodiment, the legs 202 may be equipped with leveling devices (not shown) to ensure that the reservoirs are appropriately level for optimal operation. Various types of leveling devices are well known such adjustable leveling screws.

Articles such as aerosol paint cans 10 travel through the cleaning apparatus of the present invention on a conveyor system generally indicated 12. Conveyor systems as used in the present invention are known and are commercially available. In one embodiment, the conveyor system comprises a metal belt 15. In addition, in one useful embodiment, the width of the conveyor system is at least slightly larger than the diameter of an aerosol paint can to be cleaned. Typically, aerosol paint cans have a diameter of about 2 to about 3 inches and are about 3½ to about 8½ inches tall. However, articles of other sizes may be cleaned using the cleaning apparatus of the present invention. For certain cleaning operations, it may be desirable for the width of the conveyor to be at least slightly larger than the width or diameter of the article to be cleaned. Guide rails 76 may extend along the entire length of the conveyor system or portions thereof. In one embodiment, guide rails 76 may be sized to be just slightly wider than the articles to be cleaned to prevent the articles from tipping over sideways during the cleaning operations.

Each of the reservoir end walls 20, 52 comprise cutouts or tunnels 22, 54 to allow the conveyor to pass through the upper regions 42, 68 of the reservoirs. In one embodiment, the tunnel entry and exit points are adapted to be just slightly larger than the size of an aerosol paint can to be cleaned using the apparatus. Also, in one useful embodiment, the cleaning mechanisms, e.g. the brushes, air knife and water distribution manifold are positioned far enough from the ends of each reservoir/hood so that a person who places an appendage inside one of the tunnels would not be able to reach the mechanisms and be injured.

Figure 2:
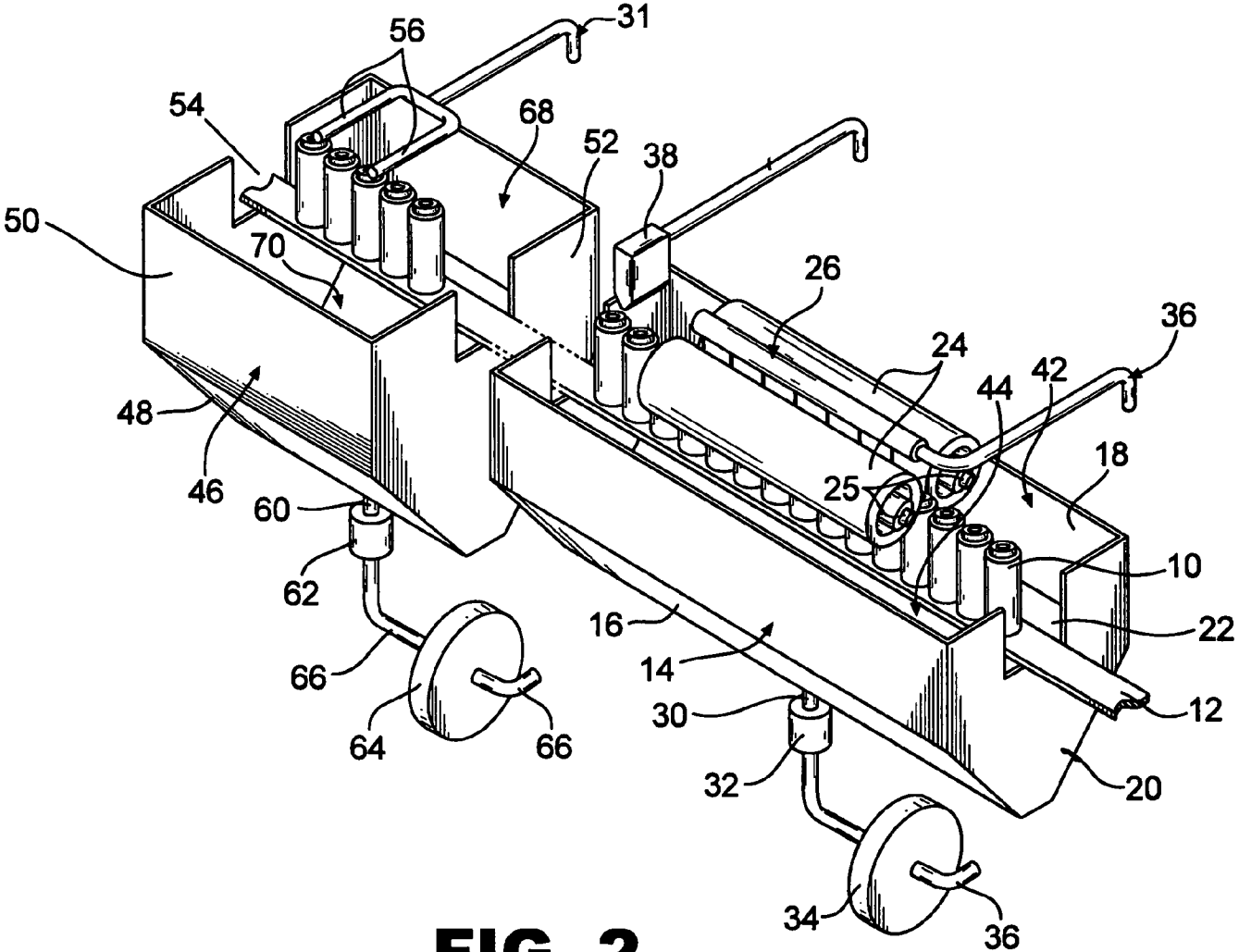
FIG. 2 is a perspective view of a first embodiment of a cleaning apparatus in accordance with the present invention.

In one embodiment, one end wall of the cleaning solution reservoir 14 is adjacent to an end wall of the water reservoir 46 as shown in FIG. 2. In another embodiment, when the first reservoir 14 contains a cleaning solution and the second reservoir 46 contains water, the reservoirs are arranged so that there is at least a small gap between the two reservoirs.

Figure 4:
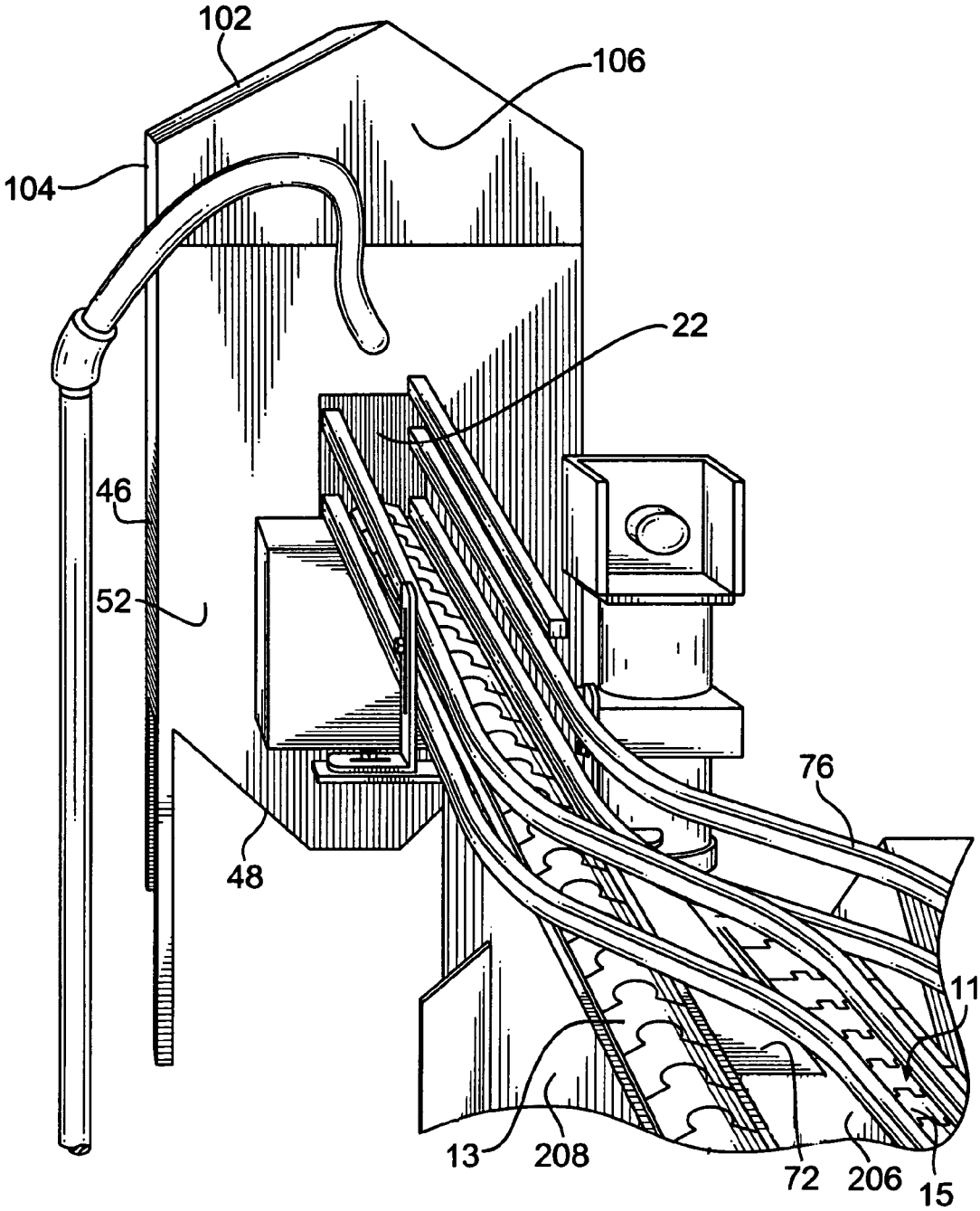
FIG. 4 is a perspective view of a conveyor system entering a reservoir in accordance with the present invention.
Figure 5:
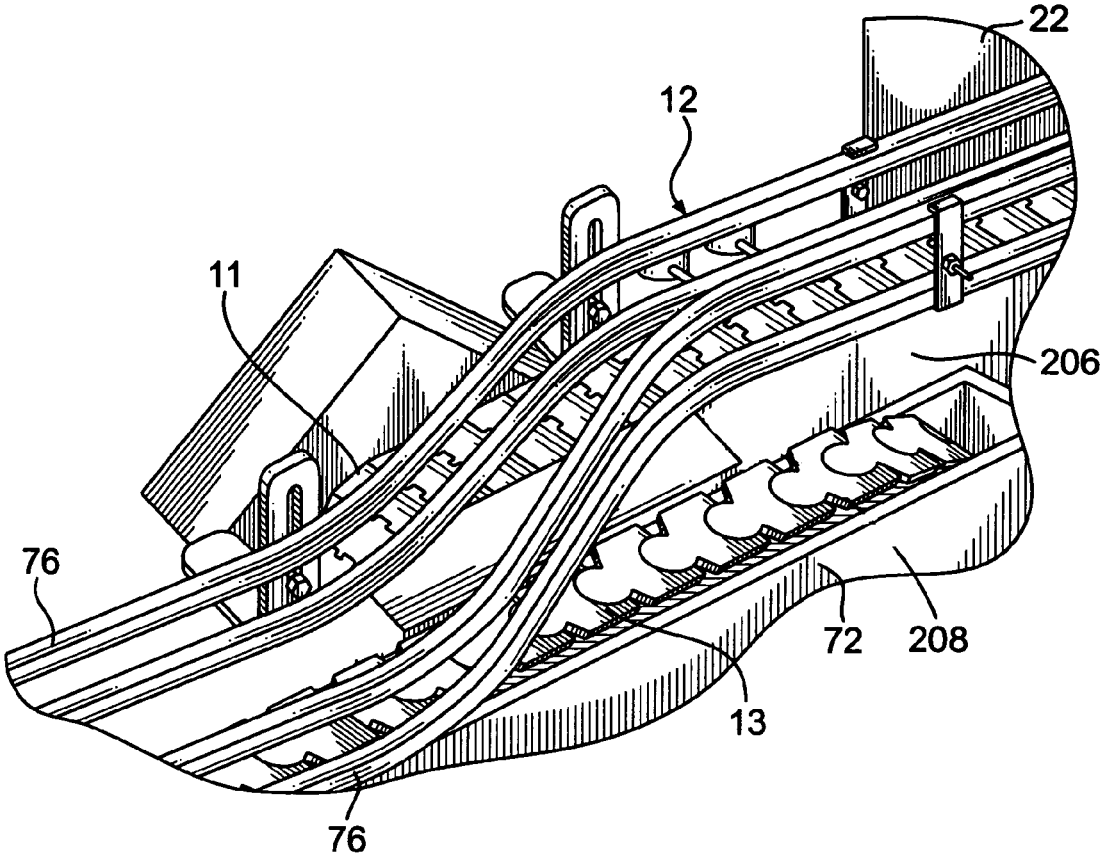
FIG. 5 is a top view of a conveyor system and dead plate in accordance with the present invention.
Figure 7:
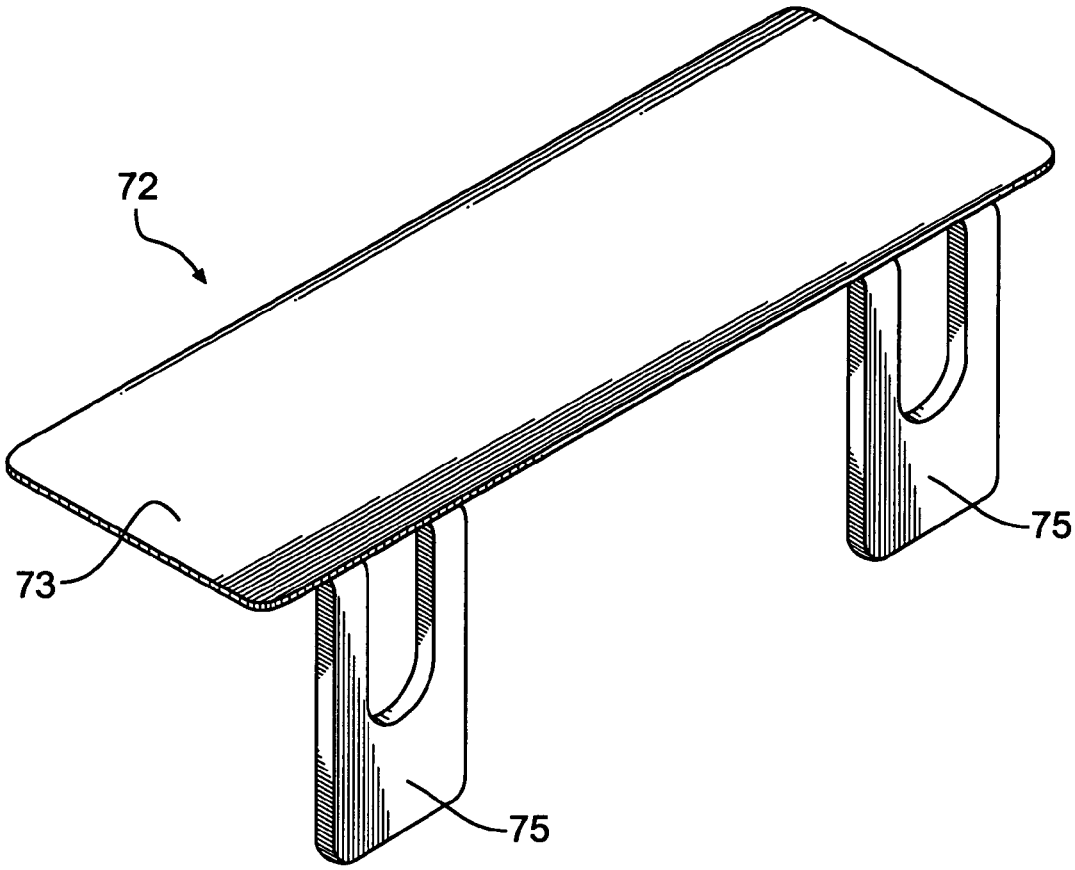
FIG. 7 is a perspective view of a "dead plate" in accordance with the present invention.

As best shown in FIGS. 4 and 5, the conveyor system may comprise two separate conveyors 11 and 13. A plate 72, referred to as a "dead plate" may be positioned between the two conveyors. The dead plate is illustrated in FIG. 7. In one embodiment, the dead plate 72 comprises a rectangular metal plate 73. In another useful embodiment, the dead plate is constructed of stainless steel. The dead plate 72 may have attachment legs 75 for use in securing the dead plate one or both of the frames 206, 208 of the conveyor system 12. The dead plate 72 may be secured to the frame of the conveyor system by any known mechanical means, such as bolts. In this embodiment, each of the reservoirs 14, 46 has its own conveyor 11, 13. The dead plate is positioned along the conveyor system 12 so that it is capable of bridging a gap between the two conveyors 11, 13. For example, the dead plate may be at the same level as the conveyors. The dead plate 72 is positioned near where the cleaning solution reservoir conveyor 11 ends and the water reservoir conveyor 13 begins. The dead plate may be secured to both conveyor frames 206, 208 or may be secured only one side. Preferably there is a small gap between each conveyor 11, 13 and the dead plate 72. The gap should be of sufficient size to avoid significant contamination of the dead plate with cleaning solution while not interfering with the progress of cans onto or across the dead plate, for example, a gap of about 0.125 inches on each side.

In use, cans 10 are pushed onto the dead plate by the motion of the first conveyor. In one embodiment, the width of the dead plate 72 is just slightly larger than the diameter of a can 10 to be cleaned. Guide rails 76 on the sides of dead plate 72 control the movement of the containers from the cleaning solution reservoir conveyor 11 onto the dead plate 72 and then onto to the water reservoir conveyor 13. As more cans are moved from the cleaning solution reservoir conveyor 11 to the dead plate 72, each can is able to push the can in front of it over the dead plate onto the water reservoir conveyor 13. The last can in a group to pass over the dead plate may either be manually moved from the cleaning solution reservoir conveyor 11 onto the dead plate 72 and/or from the dead plate to the water reservoir conveyor 13 or a pulse of compressed air may be impinged against the can to propel it across the dead plate and onto the next conveyor. When the liquids in each reservoir are different, the dead plate 72 may minimize contamination of the water in the water reservoir 46 with cleaning solution from the cleaning solution reservoir 14. The only liquid carried over the dead plate is residue from the cleaning solution that remains on the cans after cleaning. In an alternative embodiment, the conveyor system 12 may be comprised of a single continuous conveyor that runs through the upper region of both reservoirs.

The apparatus of the present invention further comprises at least one abrasive device 24 for scrubbing the cans 10. For example, the apparatus may comprise a plurality of cylindrical brushes 24. The brushes 24 may be mounted within the cleaning solution reservoir 14 and above the conveyor 11 by any known mechanical means. In one exemplary embodiment, the brushes 24 may be mounted on a rotatable shaft so that the brushes can rotate against the cans 10 as they pass by on the conveyor. In the embodiment shown in FIG. 2, two brushes 24 are each mounted on a rotatable, horizontal shaft 25. Rotation of one or both of the shafts can be accomplished by any known mechanical means, such as by a motor. In one embodiment, one or both shafts are rotated using a reduction gear transmission and an electric motor (not shown). Belts or chains may be used to connect the motor to the shaft in order to impart rotational movement to the shaft. In an embodiment where only one of the shafts is powered by a motor, the second brush may be positioned so that its bristles intermingle at least a short distance with the bristles of the first brush. In such an embodiment, as the first brush is rotated it imparts rotational movement to the second brush so that the brushes counter-rotate. The brushes may be intermeshed any distance that will allow a powered brush to impart rotational motion to the other brush, for example, a intermesh distance of approximately one inch.

Various brushes are commercially available which would be suitable for use in the present invention. By way of example, one suitable type of brush is a commercially available cylindrical polypropylene brush, with a diameter of approximately 6 inches, a length of approximately 24 inches having bristles with a diameter of approximately 0.20 inches. This particular brush is mounted on a 16-guage steel core rod that is approximately 1 inch in diameter. This example is provided as an example of a suitable brush, however, it should be understood that any brushes of other dimensions, shapes and materials would also be suitable for use in the present invention. The requirements for an abrasive device in accordance with the present invention are only that the device be capable of scrubbing without damaging the substrate.

In one embodiment, a distribution manifold 26 is operatively coupled to the cleaning solution reservoir 14 for applying cleaning solution to the brushes 24. A distribution manifold 26 in accordance with the present invention may have multiple outlets (not shown) for dispensing a liquid cleaning solution onto brushes 24. Examples of distribution manifolds may be a shower head or a pipe having a plurality of holes therein. In an alternative embodiment, the distribution manifold may comprise one or more pipes through which liquid may be pumped.

In operation, a pump 34 draws liquid from the reservoir 14 through a suitable conduit 36, such as a pipe. The pump 34 transfers the liquid through the conduit 36 to the distribution manifold 24. Various types of pumps and conduits suitable for use in the present invention are known and are commercially available.

In one useful embodiment of the present invention, an air knife 38 drying device is positioned within the cleaning solution reservoir 14, above the conveyor 11 proximate to the end of the cleaning solution reservoir 14 that is nearest the water reservoir 46. An air knife for use in the present invention may be any structure adapted to blow a stream of air. Air knives suitable for use in the present invention are known in the art and are commercially available. As an example, an air knife for use in the present invention may include a pipe having one or more holes or slits therein through which high pressure air is forced. After the cans pass through and are scrubbed by the brushes 24, the air knife 38 blows air onto the cans. In one embodiment, the air knife directs forced air onto the cans at a pressure sufficient to blow any paint solids and liquids off of the cans without blowing the cans over. For example, the air pressure from the air knife may be about 90 psig, however, other pressures may be used. The air knife 38 blows paint or other solid soils that have been loosened by the action of the brushes 24 and the cleaning solution off of the articles 10 and into the cleaning solution reservoir 14.

A conveyor 13 or the conveyor system 12 also travels through an upper region 68 of the water reservoir 46. A water distribution manifold 56, such as a shower head, is positioned within the water reservoir 46 above the conveyor 13. In one embodiment of the present invention, the water distribution manifold 56 is capable of jet spraying water onto the cans 10 at high pressures, such as approximately 1,000 psig, in a predetermined pattern. In one embodiment, the water spray performs at least two functions: (1) to remove any remaining paint or soil deposits from the outer surface of the cans 10 and (2) to rinse any remaining cleaning solution residue from the cans. It should be understood that higher or lower pressure water sprays can be used in the present invention provided that the pressure is sufficient to remove paint or soil deposits from the substrates being cleaned, but is low enough so as to not damage, dent or otherwise distort the shape of the substrate.

In use, a pump 64 draws water from the water reservoir 46 through an intake conduit 66, such as a pipe. The water is pumped to the water distribution manifold 56 through conduit 66, such as a pipe. A variety of pumps suitable for this purpose are well known and are commercially available.

Optionally, a second air knife device may be positioned above the water reservoir conveyor 13 at a point after the water jet sprayer. This air knife could function to dry the cans or other articles before they are moved for further processing.

In various cleaning systems, the problems of wastes of cleaning solutions and the disposal of hazardous wastes are a large concern. Often, cleaning solutions including water are often used for one cleaning application and then discarded. Even when water is used to clean paint from substrates, the water having paint solids residue therein is considered hazardous waste requiring special disposal procedures. The reuse of cleaning solutions and/or water for cleaning several batches of cans, would greatly reduce the total amount of hazardous wastes. In light of this, the cleaning solution reservoir 14 and the water reservoir 46 of the present invention may be equipped with recirculation devices 32, 62. The recirculation devices 32, 62 include intake conduits 30, 60. Once inside the recirculation device, the liquids containing paint or other soil solids pass through at least one separator or filter means, which remove solid particles, so that the liquids can be reused for cleaning. In one embodiment, the recirculation device attached to the cleaning solution reservoir comprises a plurality of separators and/or filters, including at least two filters. For instance, in this embodiment, the liquid may first pass through a separator designed to remove larger particles from the cleaning solution. The liquid would then pass through a filter designed to remove smaller particles from the liquid. As an example, cleaning solution may first pass through an about 5000 micron (about 0.197 inches) separator and then pass through an about 2000 micron (about 0.079 inches) filter. In this embodiment, the holes in the distribution manifold should be sufficiently large to allow paint particles smaller than about 0.079 inches in diameter to pass through. In this example, the water recirculation device may include an about 1000 micron (about 0.039 inches) filter. In this embodiment, the holes for the water distribution manifold are smaller and thus, the smaller filter size will prevent the water distribution manifold from becoming clogged.

Figure 3:
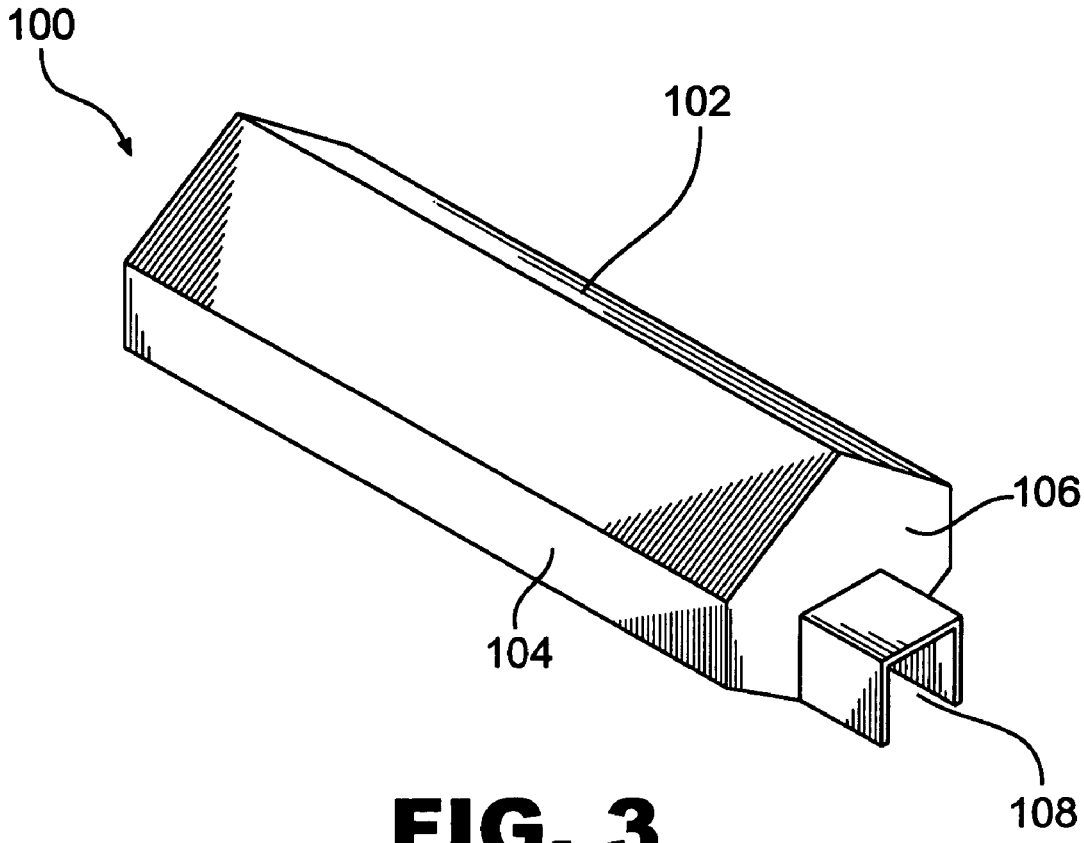
FIG. 3 is a perspective view of a hood for a cleaning apparatus in accordance with the present invention.
Figure 6:
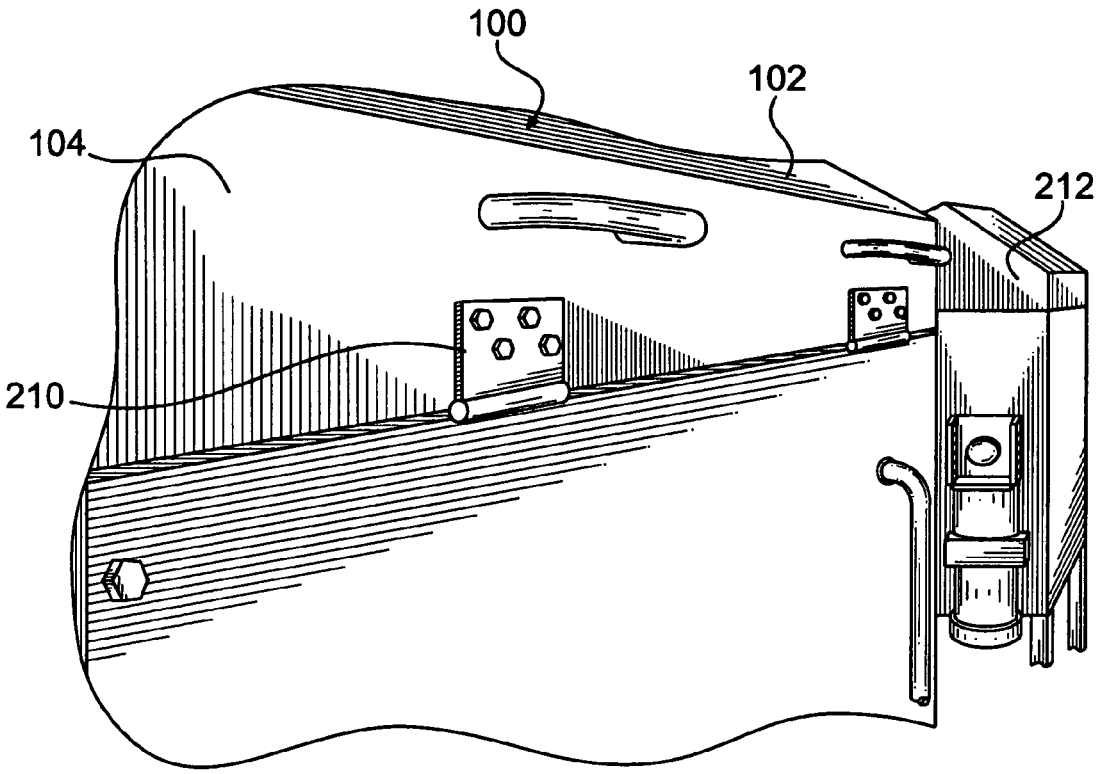
FIG. 6 is a perspective view of a reservoir and hood in accordance with the present invention.

The cleaning apparatus is covered by one or more hoods 100, such as the one shown in FIGS. 1, 3 and 6. In one embodiment of the present invention, each reservoir may have its own separate hood. The hood or hoods 100, 212 may be positioned as a dome-like structure over the reservoirs 14, 46. For example, as shown in FIG. 3, a hood in accordance with the present invention may have an inverted V-shaped upper section 102 with elongated side walls 104 extending downwardly from the inverted V-shaped section 102. End walls 106 at opposite ends of the hoods enclose the elongated hood. The end walls of the hood may have cutouts or passages 108, which correspond to the cutouts or tunnels 22 in the cleaning solution reservoir and/or water reservoir end walls. In the embodiments shown in FIGS. 1, 4, and 6, the hood 100, 212 is used to "cap" the reservoir 14, 46 and does not include cutouts or passages 108. In an alternative embodiment, both reservoirs may be covered by a single hood (not shown).

In one useful embodiment, the hood is constructed of cold-rolled steel sheet metal. However, other materials that would not be degraded by the cleaning solution used in connection with the present invention may also be used.

In one embodiment, the hood or hoods are secured to the reservoirs using hinges 210 along one of the elongated sides as shown in FIG. 6. Mechanical cables can be used to attach the opposite elongated side of the hood to the reservoir (not shown). In one useful embodiment, the cables prevent the hood from opening too far and falling over backwards.

In another embodiment, the cables prevent the hood from opening along the hinges at an angle larger than 105°. To prevent inadvertent opening of the hood during use of the apparatus, the hood may also be mechanically locked in its closed position. In one embodiment, the lock may be comprised of cylinders, which are powered by the liquid delivery systems when the apparatus is in operation.

The cleaning apparatus of the present invention may be used as a free standing cleaner where cans are manually transported and loaded into the cleaning apparatus. As an alternative embodiment, the cleaning apparatus of the present invention may be included "in-line" in the standard can filling process at any point after the cans are filled and sealed.

A method of cleaning aerosol paint containers or other articles is also provided in accordance with the present invention. The method may include several steps as described below. Although the steps are described in a particular order herein, it is contemplated that the order of steps may vary, provided that items are cleaned to the satisfaction of the system user. Articles to be cleaned are positioned on the conveyor system outside of the first reservoir and the articles are moved into the first reservoir. The conveyor provides sufficient motive force to move the articles along the cleaning apparatus without tipping. Cleaning solution is applied to the brushes, which rotate against the surface of the article to apply the solution onto the articles to be cleaned. The cleaning solution is allowed to react with soils on the article for a sufficient time to dissolve and/or soften the paint or other soil on the article. The brushes act to scrub the article to remove paint or other soils. After scrubbing, the articles may be moved along the conveyor under an air dryer, which blows air onto the brushes to remove excess cleaning solution and solids that were loosened or softened by the cleaning solution. In one embodiment of the invention, the articles exit from the cleaning solution reservoir and transfer onto a second conveyor. In another embodiment, the articles continue to travel on a single conveyor throughout the cleaning process. In any event, the articles may enter a second reservoir. Water or other rinse solution is sprayed at high pressure onto the articles to rinse off any remaining cleaning solution or soil solids. The articles may be dried by a second air knife positioned within or just outside of the second reservoir. After rinsing and/or drying, the articles are collected for further processing.

In the washing and rinsing steps the cleaning solution liquid and the rinse liquid are returned to their respective reservoirs and are able to be reused in further cleaning operations. Before the cleaning or rinsing liquids are applied to the articles to be cleaned they pass through one or more filtration devices to remove solid particles from the liquid.

Although any number of known solvents may be used as the cleaning solution in connection with the apparatus described herein, an exemplary novel cleaning solution is described below.

The cleaning solution formulation of the present invention yields compositions that are soluble with oil based resins, in particular, those resins used in aerosol paints. While that was the focus of the evaluation and formulations considered, it is to be understood that the mixtures described herein may be used in a variety of applications beyond their effectiveness in cleaning paint containers as described herein.

The cleaning solution of the present invention comprises a homogeneous mixture of two organic solvents (Solvent A and Solvent B). In one embodiment, Solvent A is a coalescing agent and Solvent B is a hydrocarbon. In one example, Solvent A may be selected from glycol ethers. In another example, Solvent B may be an isoparaffin hydrocarbon. In a further example, Solvent B may be a mixture of isoalkanes having 10-16 carbons. Further for example, both Solvent A comprises about 50% by weight of the cleaning solution and Solvent B comprises about 50% by weight of the cleaning solution. Further, in one useful embodiment, Solvents A and B are both equally dispersed within the solution.

Solvent A is may be selected from various known coalescing solvents such as glycol ethers. For example, Solvent A may be a hydrophobic glycol ether. Further for example, Solvent A may be proplylene glycol mono-n-propyl ether (PGnPE). PGnPE is commercially available from a variety of sources. Some commercially available PGnPE suitable for use in the present invention includes PROPASOL® Solvent P available from Union Carbide Chemical Company, ARCOSOLV® PNP available from Lyondell Chemical Company, and DOWANOL® PNP available from Dow Chemical, Inc.

Solvent B may be selected from a petroleum-derived hydrocarbon. In one embodiment, Solvent B may be a mixture of isoalkanes. For example, Solvent B may be a mixture of isoalkanes having about 10 to about 16 carbons. In another example, Solvent B may be a mixture of C13-C16 isoalkanes. The concentrations of the components of Solvent B may vary. In one embodiment, Solvent B may exhibit strong hydrophobic tendencies. In addition, in one embodiment, each individual component of Solvent B has a flash point above about 150° F., such as about 150° F. to about 200° F. Each component of the isoalkane mixture solution contributes to the overall vapor pressure of the final cleaning solution of the present invention. The contributions of each component of the isoalkane mixture can be calculated on a weight percent basis. In one useful embodiment, Solvent B may be comprised of any number of components, wherein each component is an isoalkane whose number of carbons is 10-16, the inclusion of said component does not cause the flash point of Solvent B as a whole to drop below about 150° F., and the cleaning solution as a whole does not leave an undesirable residue on the surface of the can after cleaning and rinsing. A commercially available isoparaffin solvent suitable for use as Solvent B in the present invention is SOLTROL® 220 available from Chevron Phillips Chemical Company LP. According to published data, SOLTROL® 220 has a flash point of greater than 210° F. measured according to ASTM D93.

In one embodiment of the present invention, a cleaning solution has a flash point that is at least about 100° F. or greater than about 100° F. For example, a cleaning solution of the present invention may have a flash point that is about 130° F. In addition, in one useful embodiment, the cleaning solution has an evaporation rate of approximately 0.49 milliliters/hour at about 70° F.

In one useful embodiment, during the preparation of the cleaning solution of the present invention, the overall vapor pressure of the cleaning solution should be considered.

In one embodiment, the vapor pressure of the cleaning solution is about 68.95 Pa. The determination of the relative concentrations of the components of Solvent B may also be based on their contribution to the overall vapor pressure of the cleaning solution. The contribution to vapor pressure for each component of the cleaning solution can be estimated using Raoult's Law. For example, if the desired vapor pressure of the cleaning solution is 68.95 Pa and Solvent B has three components, the weight percent of each component in Solvent B can be calculated by the following equation:

$$VP_{Solvent\ B} \approx 68.95\ \text{Pa} = x_1 VP_1 + x_2 VP_2 + x_3 VP_3$$

wherein VP is the vapor pressure (absolute basis) and x is the component's weight percent in Solvent B.

One of the problems with using cleaning compositions, which are immiscible in water and have a relatively high flash point is that these compositions tend to leave a residue on the cleaned substrate. Such residues may be problematic in the container industry in general because they can hinder the adherence of a label to the container or potentially destroy labels on the containers. For instance, in the paint industry, the trend is to use laminated polyethylene film labels on aerosol paint cans. Use of cleaning solutions containing lower isoalkanes may leave a residue on the outside of the container that can destroy the adherence of these polyethylene film labels to the cans. Residues left on the containers may also contaminate the hot water immersion baths used in the paint packaging process, causing additional hazardous waste to be disposed of. Thus, in one embodiment of the invention, the components of the cleaning solution are selected to provide sufficient cleaning capability without leaving substantially no undesirable residue on the cleaned article.

The cleaning solution of the present invention functions to remove cured or uncured oil-based paint resin from metal containers or other non-porous substrates. Without limiting the scope of the invention to any particular theory, the cleaning solution operates to clean a substrate as follows: As the cleaning solution contacts the surface to be cleaned, Solvent B eliminates the bonds that adhere the paint to the metal container. Solvent B reduces the interfacial tension of the paint to create an emulsion, which carries the paint in solution with the cleaning solution of the present invention for a short time. Once the paint is in emulsion with the cleaning solution, Solvent A allows for flocculation of the emulsion. Once the emulsion is broken, the paint molecules begin to coagulate and fall out of the solution. Such coagulated particles are easily separated out of the cleaning solution by filtration.

The cleaning solution of the present invention can be prepared in batches as small as about 500 ml or as large as about 500 gallons or more. The cleaning solution may be prepared by mixing Solvents A and B with any known mechanical agitation device until a homogeneous uniform solution is achieved. In a preferred embodiment, the cleaning solution is prepared at 1 atmosphere of pressure at 298.15° K.

The following example is illustrative of the present invention and is not meant to, and should not be construed to limit the scope of the present invention.

EXAMPLE

A cleaning solution in accordance with the present invention was prepared by adding the following ingredients to a 4000 ml stainless steel beaker at room temperature:

| Solvent | Volume | Weight | Weight % |
|---|---|---|---|
| SOLTROL ® 220<br>Mixture of C13-C16 Isoalkanes | ~1,551 ml | 1,250 g | 50 |
| DOWANOL ® PNP<br>Propylene Glycol n-Propyl Ether | ~1,411 ml | 1,250 g | 50 |

The two solvents were readily miscible with each other and no reaction occurred upon their combination. The beaker was placed on a magnetic stir plate and a magnetic stir bar was added to the beaker. The cleaning solution was stirred for approximately 30 seconds to produce a clear, water white, homogeneous solution.

The cleaning solution was tested by first applying it to cans using a soft brush. The cleaning solution was allowed to react with the paint residue on the cans for about 30 seconds and then was removed using a standard lab wipe. It was found that the cleaning solution removed all of the paint drips from the outside surface of the container.

While the present invention has been illustrated by the description of embodiments thereof, and while the embodiments have been described in considerable detail, it is not the intention of the applicants to restrict or in any way limit the scope of the appended claims to such detail. Additional advantages and modifications will readily appear to those skilled in the art. Therefore, the invention, in its broader aspects, is not limited to the specific details, the representative apparatus or formulation, and illustrative examples shown and described. Accordingly, departures may be made from such details without departing from the spirit or scope of the applicant's general inventive concept.

The invention claimed is:

1. An apparatus for cleaning articles, the apparatus comprising:

a first reservoir for holding a first liquid;

a first conveyor running through said first reservoir;

a second reservoir for holding a second liquid;

a second conveyor running through said second reservoir;

a pair of rotatable brushes positioned above said first conveyor;

a first distribution manifold adapted to apply liquid from said first reservoir onto said pair of rotatable brushes;

a first pump for delivering liquid from said first reservoir to said distribution manifold;

a first filter system positioned between said first reservoir and said first pump;

an air knife positioned above said first conveyor;

a second distribution manifold positioned above said second conveyor;

a second pump for delivering liquid from said second reservoir to said distribution manifold;

a second filter system positioned between said second reservoir and said second pump; and a plate positioned between said first and second conveyors, said plate adapted to receive an article as said article passes from said first conveyor.

2. The apparatus as recited in claim 1, wherein said first liquid is a cleaning solution.

3. The apparatus as recited in claim 2, wherein said cleaning solution comprises a mixture of a glycol ether and an insoparaffin hydrocarbon solvent.

4. The apparatus as recited in claim 2, wherein the cleaning solution comprises a mixture of propylene glycol mono-n-propyl ether and a mixture of C13-C16 isolakanes.

5. The apparatus as recited in claim 4, wherein the propylene glycol n-propyl ether comprises about 50% by weight of the cleaning solution and the mixture of C13-C16 isoalkanes comprises about 50% by weight of the cleaning solution.

6. The apparatus as recited in claim 4, wherein the second liquid is water.

7. The apparatus as recited in claim 1, wherein said article is a filled aerosol paint can.

8. An apparatus for washing articles using a cleaning solution and water, the apparatus comprising:

an elongated cleaning solution reservoir comprising a lower section, a pair of lateral side walls extending upwardly from said lower section, and first and second end walls enclosing opposite ends of said lower section and said lateral side walls;

first and second tunnels formed in each of said first and second walls in said cleaning solution reservoir, wherein said tunnels are adapted to allow an article to pass through said tunnel;

a first conveyor running through said cleaning solution reservoir, said conveyor adapted to transport said article through said cleaning solution reservoir;

an elongated water reservoir comprising a lower section, a pair of lateral side walls extending upwardly from said section, and first and second end walls enclosing opposite ends of said lower section and said lateral side walls;

first and second tunnels formed in each of said first and second end walls, wherein said tunnels are adapted to allow said article to pass through said tunnels;

a second conveyor running through said water reservoir, said conveyor adapted to transport said article through said water reservoir;

a rectangular plate positioned between said first conveyor and said second conveyor, wherein said plate is level with said first and second conveyors, and wherein a gap of about 0.125 inches separates the plate from each of said first and second conveyors;

guide rails for guiding the movement of said article between said first and second conveyor;

a first brush, having a plurality of bristles, positioned above said first conveyor proximate to said first end wall of said cleaning solution reservoir, wherein said first brush is mounted on a first rotatable horizontal shaft;

a reduction gear transmission connected to said first rotatable horizontal shaft;

a motor coupled to said reduction gear transmission;

a second brush, having a plurality of bristles, positioned above said first conveyor proximate to said first end wall of said cleaning solution reservoir, wherein said second brush is mounted on a second rotatable horizontal shaft and wherein the bristles of said second brush overlap with the bristles of said first brush so that rotation of said first brush imparts rotational movement to said second brush;

a cleaning solution distribution manifold positioned above said first and second brushes for dispensing a cleaning solution from said cleaning solution reservoir onto said brushes;

a first pump for pumping cleaning solution from said cleaning solution reservoir to said cleaning solution distribution manifold;

a first recirculation device positioned between said cleaning solution reservoir and said first pump, comprising an intake and at least one filter for removing particles from said cleaning solution as it passes through said recirculation device to said first pump;

an air knife positioned above said first conveyor proximate to said second end wall of said cleaning solution reservoir;

a high pressure water distribution manifold positioned above said second conveyor for dispensing water onto cans traveling on said conveyor in a predetermined pattern;

a second pump for pumping water from said water reservoir to said high pressure water distribution manifold;

a second recirculation device positioned between said water reservoir and said second pump, comprising an intake and at least one filter for removing particles from water as it passes through said recirculation device to said second pump;

a first hood positioned over said cleaning solution reservoir, said brushes, said cleaning distribution manifold, and said air knife; and a second hood positioned over said water reservoir and said water distribution manifold.

9. The apparatus as recited in claim 8 wherein said cleaning solution is a mixture of about 50% by weight propylene glycol mono-n-propyl ether and about 50% by weight C13-C16 isoalkanes.

10. An apparatus for washing filled aerosol paint cans comprising:

a reservoir for holding a cleaning liquid;

a reservoir for holding a rinse liquid;

a conveyor running through said reservoirs;

a pair of rotatable brushes positioned above said conveyor for applying said cleaning liquid to said cans;

an air knife positioned above said conveyor;

a shower head adapted to apply said rinse liquid to said cans;

means for filtering said first and second liquids before said cleaning liquid and said rinse liquid are applied to said cans; and guide rails positioned along the conveyor for controlling movement of the cans along the conveyor.

* * * * *